US011245228B2

(12) United States Patent
Takeuchi et al.

(10) Patent No.: US 11,245,228 B2
(45) Date of Patent: Feb. 8, 2022

(54) CONNECTOR AND CONNECTOR ASSEMBLY HAVING A CONNECTOR POSITION ASSURANCE DEVICE

(71) Applicant: Tyco Electronics Japan G.K., Kawasaki (JP)

(72) Inventors: Hiroshi Takeuchi, Kawasaki (JP); Hiromichi Yoshino, Kawasaki (JP)

(73) Assignee: Tyco Electronics Japan G.K., Kawasaki (JP)

( * ) Notice: Subject to any disclaimer, the term of this patent is extended or adjusted under 35 U.S.C. 154(b) by 0 days.

(21) Appl. No.: 16/856,427

(22) Filed: Apr. 23, 2020

(65) Prior Publication Data

US 2020/0251857 A1 Aug. 6, 2020

Related U.S. Application Data

(63) Continuation of application No. PCT/JP2018/038615, filed on Oct. 17, 2018.

(30) Foreign Application Priority Data

Oct. 23, 2017 (JP) ..... JP2017-204290

(51) Int. Cl.
*H01R 13/641* (2006.01)
*H01R 13/22* (2006.01)
(Continued)

(52) U.S. Cl.
CPC ..... *H01R 13/641* (2013.01); *H01R 13/22* (2013.01); *H01R 13/506* (2013.01); *H01R 13/629* (2013.01); *H01R 13/6272* (2013.01)

(58) Field of Classification Search
CPC ..... H01R 13/6271; H01R 13/6272; H01R 13/6275; H01R 13/641; H01R 13/22; H01R 13/506; H01R 13/629
(Continued)

(56) References Cited

U.S. PATENT DOCUMENTS 5,910,027 A * 6/1999 Wayt ..... H01R 13/641 439/352
6,261,115 B1 * 7/2001 Pederson ..... H01R 13/6272 439/352
(Continued)

FOREIGN PATENT DOCUMENTS

CN 101652818 A 2/2010
CN 102570109 B 4/2014
(Continued)

OTHER PUBLICATIONS

Extended European Search Report in Application No. 18871256.6-1201/3703196, dated Jun. 17, 2021, 9 pp.
(Continued)

*Primary Examiner* — Marcus E Harcum
(74) *Attorney, Agent, or Firm* — Barley Snyder

(57) ABSTRACT

A connector includes a housing and a connector position assurance device (CPA). The CPA is movable between a first position and a second position and assures that the connector is completely mated with a mating connector or maintains a completely mated state in the second position. The housing has a mating portion, a guiding portion, and an abutting portion. The CPA has a base portion guided by the guiding portion and a beam portion. The abutting portion abuts on the beam portion in the first position during non-mating with the mating connector to block movement of the CPA to the second position. The mating connector during complete mating deforms the beam portion to remove the abutment of the beam portion on the abutting portion to allow the CPA to move to the second position.

20 Claims, 8 Drawing Sheets

(51) Int. Cl.
*H01R 13/506* (2006.01)
*H01R 13/627* (2006.01)
*H01R 13/629* (2006.01)

(58) Field of Classification Search
USPC ..... 439/351, 352
See application file for complete search history.

(56) References Cited

U.S. PATENT DOCUMENTS

| | | | | |
|---|---|---|---|---|
| 6,712,635 | B1 * | 3/2004 | Nimura | H01R 13/6272 439/352 |
| 6,780,045 | B2 | 8/2004 | Shuey et al. | |
| 7,470,138 | B1 * | 12/2008 | Chen | H01R 13/506 439/352 |
| 7,909,638 | B2 * | 3/2011 | Seo | H01R 13/6272 439/489 |
| 8,835,771 | B2 | 9/2014 | Masago et al. | |
| 9,478,906 | B2 * | 10/2016 | Myer | H01R 13/6273 |
| 9,608,373 | B2 * | 3/2017 | Wu | H01R 13/6272 |
| 9,893,464 | B2 * | 2/2018 | Endo | H01R 13/6271 |
| 9,935,396 | B2 | 4/2018 | Endo et al. | |
| 2003/0157825 | A1 * | 8/2003 | Kane | H01R 13/641 439/352 |
| 2004/0023547 | A1 * | 2/2004 | Oka | H01R 13/6272 439/352 |
| 2009/0247000 | A1 * | 10/2009 | Shuey | H01R 13/4365 439/358 |
| 2010/0062635 | A1 * | 3/2010 | Jones, Jr. | H01R 13/639 439/370 |
| 2012/0282791 | A1 * | 11/2012 | Brown | H01R 13/639 439/157 |
| 2013/0014979 | A1 | 1/2013 | Cyprian et al. | |
| 2013/0260590 | A1 * | 10/2013 | Hitchcock | H01R 13/6397 439/312 |
| 2015/0295354 | A1 * | 10/2015 | Morello | H01R 13/639 439/352 |
| 2016/0072226 | A1 * | 3/2016 | Puhl | H01R 13/641 439/352 |
| 2016/0118741 | A1 * | 4/2016 | Schmidt | H01R 13/44 439/131 |
| 2020/0321731 | A1 * | 10/2020 | Misu | H01R 13/64 |

FOREIGN PATENT DOCUMENTS

| | | | |
|---|---|---|---|
| CN | 105552642 | A | 5/2016 |
| EP | 0449122 | A2 | 10/1991 |
| EP | 0655807 | A2 | 5/1995 |
| EP | 2637260 | A1 | 9/2013 |
| JP | 03285280 | | 12/1991 |
| JP | H08-007982 | A | 1/1996 |
| JP | 2003-264039 | A | 9/2003 |
| JP | 2013-214495 | A | 10/2013 |
| JP | 2016-85979 | A | 5/2016 |
| JP | 2017-157454 | A | 9/2017 |
| JP | 2018-60666 | A | 4/2018 |

OTHER PUBLICATIONS

Chinese Office Action and English translation, dated Jul. 9, 2021, 24 pages.
Japanese Office Action and English translation, dated Jul. 13, 2021, 12 pages.

* cited by examiner

CONNECTOR AND CONNECTOR ASSEMBLY HAVING A CONNECTOR POSITION ASSURANCE DEVICE

CROSS-REFERENCE TO RELATED APPLICATIONS

This application is a continuation of PCT International Application No. PCT/JP2018/038615, filed on Oct. 17, 2018, which claims priority under 35 U.S.C. § 119 to Japanese Patent Application No. 2017-204290, filed on Oct. 23, 2017.

FIELD OF THE INVENTION

The present invention relates to a connector and, more particularly, to a connector having a connector position assurance device.

BACKGROUND

Some connectors have a connector position assurance device (CPA), which can move to a specific position only after the connector and a mating connector are completely mated. The connector position assurance device assures that the connectors are in a completely-mated state or are maintaining the completely-mated state from the fact that it has moved to the specific position. Japanese Patent Application No. 2003-264039A, for example, discloses a connector in which a rail for guiding sliding of a CPA is provided in a mating portion matching with a mating connector so that the CPA can slide when the connector is completely mated with the mating connector.

A connector provided with a CPA is also required to be miniaturized. In order to meet this requirement, if a structure disclosed in JP 2003-264039A is followed to form a connector, in particular, having a narrow width, the latch width of a connector housing and the width of the CPA become narrow. As a result, it can be difficult to place the rail for guiding sliding of the CPA.

SUMMARY

A connector includes a housing and a connector position assurance device (CPA). The CPA is movable between a first position and a second position and assures that the connector is completely mated with a mating connector or maintains a completely mated state in the second position. The housing has a mating portion, a guiding portion, and an abutting portion. The CPA has a base portion guided by the guiding portion and a beam portion. The abutting portion abuts on the beam portion in the first position during non-mating with the mating connector to block movement of the CPA to the second position. The mating connector during complete mating deforms the beam portion to remove the abutment of the beam portion on the abutting portion to allow the CPA to move to the second position.

BRIEF DESCRIPTION OF THE DRAWINGS

The invention will now be described by way of example with reference to the accompanying Figures, of which.

DETAILED DESCRIPTION OF THE EMBODIMENT(S)

Figure 1A:
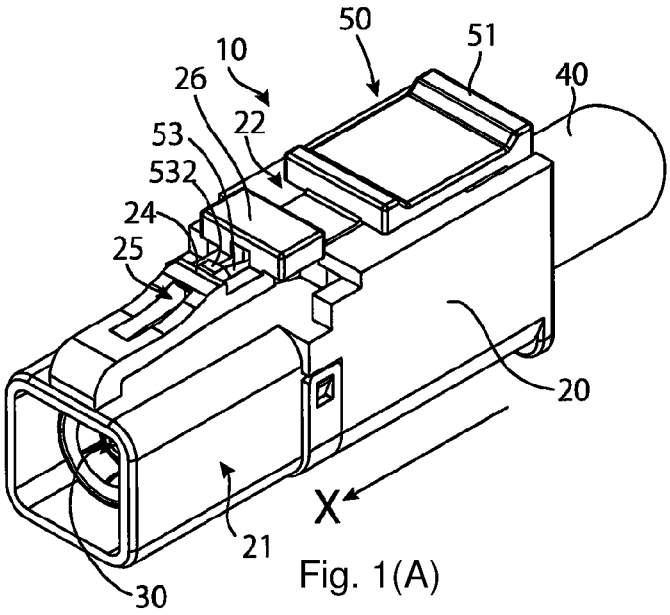
FIG. 1(A) is a perspective view of a first connector.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art. Furthermore, several aspects of the embodiments may form—individually or in different combinations—solutions according to the present invention. The following described embodiments thus can be considered either alone or in an arbitrary combination thereof.

Figure 1B:
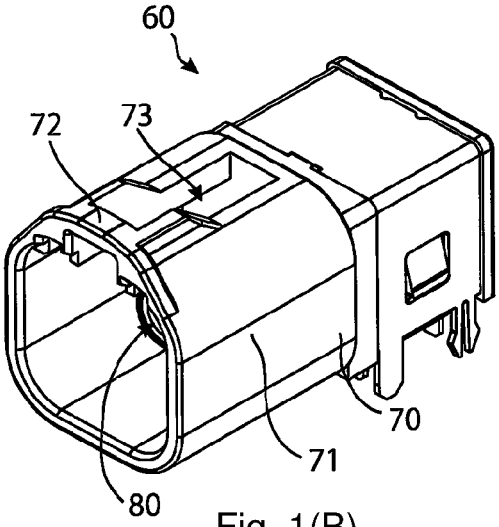
FIG. 1(B) is a perspective view of a second connector.

FIGS. 1(A) and 1(B) are isometric views of a first connector 10 and a second connector 60, respectively, that are matable with each other. FIGS. 1(A) and 1(B) show isometric views of both the first connector 10 and the second connector 60 in an attitude having mutually-matching mating portions facing obliquely frontward. The first connector 10 may be referred to as just a "connector" herein, and the second connector 60 may be referred to as a "mating connector." The combination of the first connector 10 and the second connector 60 form a connector assembly according to an embodiment.

Figure 4A:
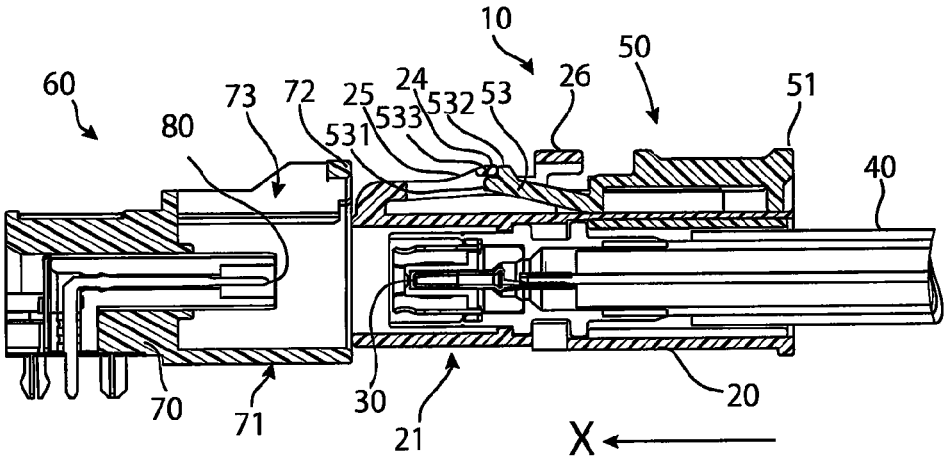
FIG. 4(A) is a sectional side view of the first connector and the second connector before the start of mating.

As shown in FIGS. 1(A) and 4(A), the first connector 10 has a first housing 20 and a female contact 30 positioned within the first housing 20. The female contact 30 is connected with a cable 40. The first connector 10 has a connector position assurance device (CPA) 50. The CPA 50 slides between a first position shown in FIG. 1(A) and a second position in which the CPA 50 has slid in a direction of an arrow X, that is, in a direction toward the second connector 60 during mating, in relation to the first housing 20 from this first position. The details of the CPA 50 will be described in greater detail below.

Figure 4B:
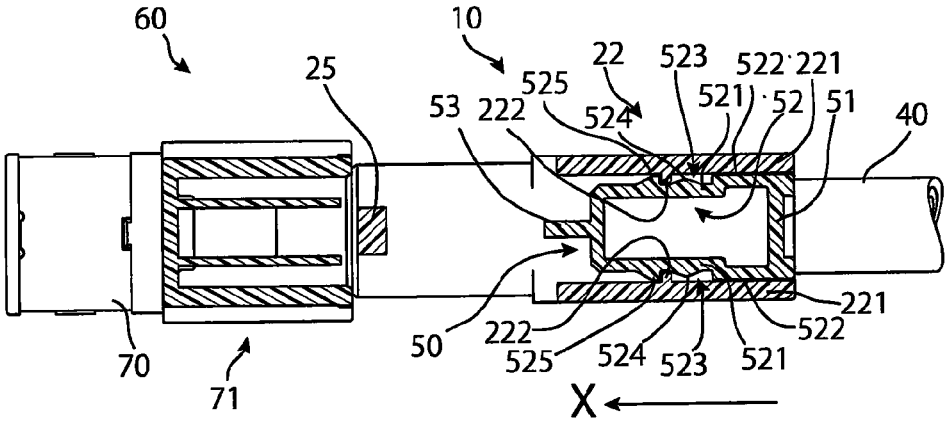
FIG. 4(B) is a sectional top view of the first connector and the second connector before the start of mating.

The first housing 20 of the first connector 10, as shown in FIG. 1(A), has a mating portion 21 functioning to mate with the second connector 60, and a guiding portion 22 for guiding sliding of the CPA 50. The guiding portion 22 is provided at a rear farther from the second connector 60 than the mating portion 21. It should be noted that, though the guiding portion 22 is provided behind the mating portion 21 in the present embodiment, the guiding portion 22 may extend to the mating portion 21 according to the shape of the mating connector 60. This enables the guiding portion 22 to secure a sufficient length regardless of a limitation of a depth direction. Thereby, the connector 10 has a structure suitable for a narrow connector The second connector 60, as shown in FIGS. 1(B), 4(A), and 4(B), has a second housing 70 and a male contact 80 positioned within the second housing 70. An abutment removal portion 72 doubling as a locking portion and a locking groove 73 are provided in a mating portion 71 of the second housing 70. Their actions will be described later. Once the first connector 10 and the second connector 60 mate with each other, the male contact 80 of the second connector 60 penetrates the female contact 30 of the first connector 10 and they are electrically connected.

Figure 2:
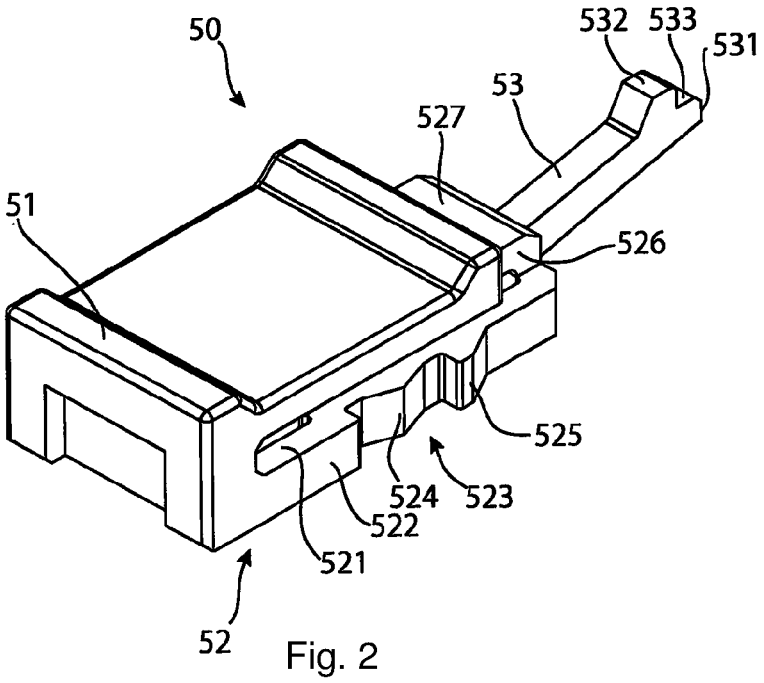
FIG. 2 is a perspective view of a connector position assurance device (CPA)

The CPA 50, as shown in FIGS. 1(A) and 2, has an operating portion 51, a base portion 52, and a beam portion 53. The operating portion 51 is a portion operated by a user. The operating portion 51 also has a role as an indicator whose position is visually confirmed, thereby indicating whether or not the CPA 50 has been in the second portion indicative of complete mating.

The base portion 52 is a portion supported on the first housing 20 of the first connector 10 and simultaneously guided to slide. The base portion 52 has a pair of beams 521, as shown in FIGS. 2 and 4(B), extending in a sliding direction (the direction of the arrow X shown in FIGS. 1(A) and 1(B)), and has a guided portion 522, a spaced portion 523, a bulging portion 524, and a retaining portion 525 on an external side face of each beam 521. The respective actions of these portions will be described later.

The beam portion 53 of the CPA 50 protrudes in the direction of the arrow X shown in FIG. 1(A) from the base portion 52 such that its distal end portion 531 reaches the mating portion 21 of the first housing 20. A protrusion 532 protruding upward is formed in a position behind a distal end 531 of this beam portion 53, as shown in FIGS. 1(A) and 2. Because the protrusion 532 is formed in a position behind the distal end 531 of the beam portion 53, a stepped portion 533 is formed between the protrusion 532 and the distal end 531 in this beam portion 53.

The CPA 50 is positioned in the first position shown in FIG. 1(A) in relation to the first housing 20 of the first connector 10 before the first connector 10 and the second connector 60 are mated. The CPA 50 is so placed on top of the first housing 20 as to have the operating portion 51 facing rearward. The beam portion 53 of the CPA 50 passes under an operating portion 26 of a locking arm 25 provided on top of the first housing 20 and extending like a cantilever rearward and obliquely upward, and extends frontward (in the direction of the arrow X) to the mating portion 21 of the first housing 20.

As shown in FIG. 1(A), the protrusion 532 provided in the vicinity of the distal end of the beam portion 53 is butted against an abutting portion 24 provided so as to protrude on an upper face side of the mating portion 21 of the first housing 20. The abutting portion 24 is provided at an upper end of the locking arm portion 25. Because of this butting, the CPA 50 cannot slide from the first position shown in FIG. 1(A) even if the operating portion 51 is pushed frontward (in the direction of the arrow X), and consequently stays in the first position. The butting of the protrusion 532 of the CPA 50 against the abutting portion 24 is removed by the abutment removal portion 72 (see FIG. 1(B)) of the second connector 60 at the time when the first connector 10 and the second connector 60 have been completely mated, as will be described in greater detail below.

Next, the course of mating of the first connector 10 and the second connector 60 will be sequentially described. In that description, the operation and action of the CPA 50 will also be described.

Figure 3A:
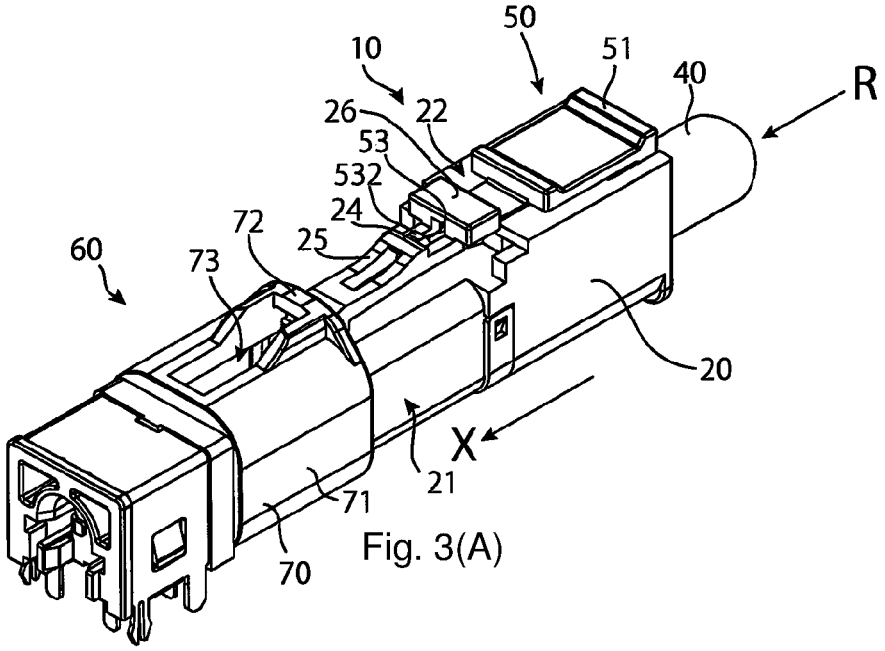
FIG. 3(A) is a perspective view of the first connector and the second connector in a state before a start of mating.
Figure 3B:
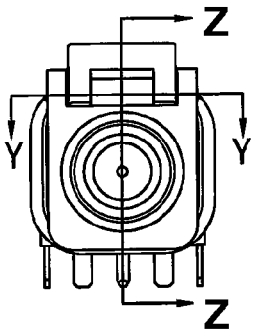
FIG. 3(B) is an end view of the first connector and the second connector before the start of mating.

FIGS. 3(A) and 3(B) are views showing a state before the start of mating of the first connector 10 and the second connector 60 aligned in their mating directions. Here, FIG. 3(A) is an isometric view, and FIG. 3(B) is a rear view of a connector assembly composed of the first connector 10 and the second connector 60 shown in FIG. 3(A) as viewed in a direction of an arrow R.

FIGS. 4(A) and 4(B) are cross sectional views of the first connector 10 and the second connector 60 in the state before mating shown in FIGS. 3(A) and 3(B). FIG. 4(A) is a longitudinal sectional view taken along arrows Z-Z shown in FIG. 3(B). FIG. 4(B) is a transverse sectional view taken along arrows Y-Y shown in FIG. 3(B).

Here, first of all, with reference to FIGS. 3(A) and 3(B) and FIGS. 4(A) and 4(B), a relation between the CPA 50 and the first housing 20 in the first position will be further described.

As shown in FIGS. 3(A)-4(B), the base portion 52 of the CPA 50 is positioned on top of the first housing 20. The guiding portion 22 guides sliding of the base portion 52. The guiding portion 22 has a pair of guiding rails 221 slidably holding the base portion 52 of the CPA 50 from both widthwise sides crossing the sliding direction (the direction of the arrow X), as shown in FIG. 4(B). On the other hand, the base portion 52 of the CPA 50 has the two beams 521 extending in the sliding direction (the direction of the arrow X) along each of the two guiding rails 221. The guided portion 522, the spaced portion 523, the bulging portion 524, and the retaining portion 525, which are also shown in FIG. 2, are provided on the external side face of each of the two beams 521.

The guided portion 522 is a portion which is in contact with the guiding rail 221 and with which sliding of the CPA 50 is guided. The spaced portion 523 is a portion adjacent to a front of the guided portion 522 and spaced from the guiding rail 221. The bulging portion 524 is a portion bulging outward in a width direction toward the guiding rail 221 within the spaced portion 523. Furthermore, the retaining portion 525 is a portion adjacent to a front of the spaced portion 523 and protruding outward in the width direction toward the guiding rail 221.

A protruding portion 222 is provided on the guiding portion 22 of the first housing 20. The protruding portion 222 is located in front of the bulging portion 524 when the CPA 50 is in the first position shown in FIGS. 3(A) and 3(B) and FIGS. 4(A) and 4(B), and protrudes widthwise from the guiding rail 221 into the spaced portion 523. One role of this protruding portion 222 is to abut against the retaining portion 522 to prevent the CPA 50 from slipping off in a direction opposite to the direction of the arrow X from the first housing 20. Also, this protruding portion 222 plays the role of interfering with the bulging portion 524 when the CPA 50 slides frontward (in the direction of the arrow X) from the first position shown in FIGS. 4(A) and 4(B) to increase resistance to the sliding to give a click feel. The base portion 52 of the CPA 50 has the two beams 521, the beam 521 elastically deflects inward in the width direction when the protruding portion 222 interferes with the bulging portion 524, and a moderate resistance is given to the sliding of the CPA 50.

As shown in FIG. 1(A), the protrusion 532 provided on the beam portion 53 of the CPA 50 abuts on the abutting portion 24 of the first housing 20 to block frontward (in the direction of the arrow X) sliding of the CPA 50. However, the beam portion 53 of the present embodiment has a frontward-elongated shape. Here, suppose that a structure is adopted that uses only the abutment between this protrusion 532 and the abutting portion 24 to block the sliding of the CPA 50. In that case, if the operating portion 51 is pushed with a strong force, abnormal deformation can occur in the beam portion 53. Then, the occurrence of the abnormal deformation can cause the CPA 50 to slide frontward (in the direction of the arrow X) even in a step before the complete mating of the first connector 10 and the second connector 60. Therefore, in the present embodiment, when the CPA 50 in the first position is pushed, the interference between the protruding portion 222 protruding from the guide rail 221 and the bulging portion 524 of the base portion 52 acts as resistance to disperse the pushing force, thereby preventing the occurrence of the abnormal deformation of the beam portion 53 to keep the CPA 50 back to the first position.

Figure 5:
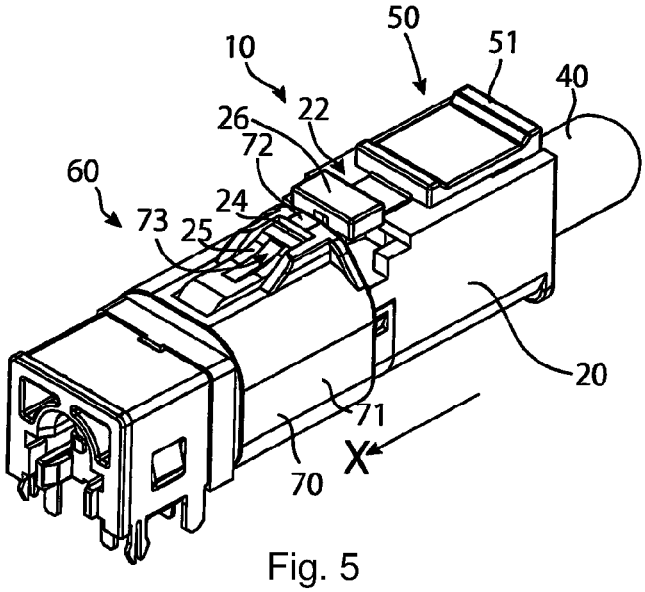
FIG. 5 is a perspective view of a connector assembly including the first connector and the second connector in a mated state.
Figure 6A:
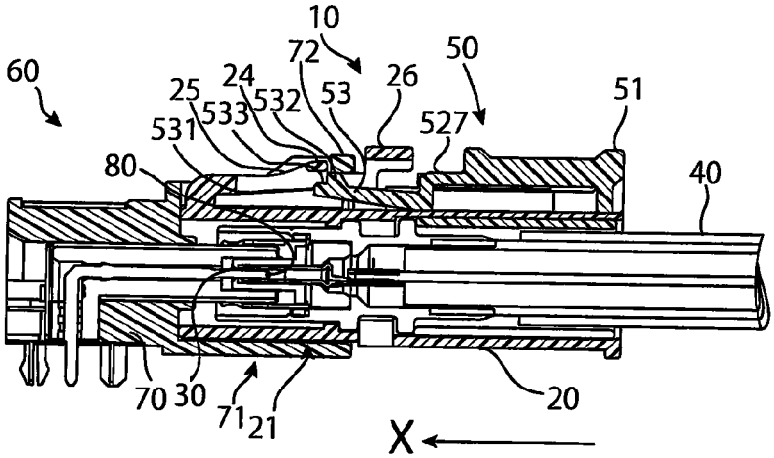
FIG. 6(A) is a sectional side view of the first connector and the second connector in the mated state.
Figure 6B:
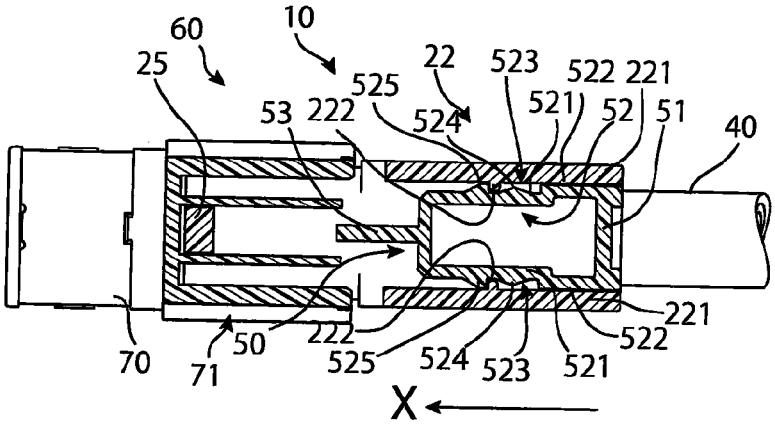
FIG. 6(B) is a sectional top view of the first connector and the second connector in the mated state.

FIG. 5 is an isometric view of the connector assembly composed of the first connector 10 and the second connector 60 in a mated state. FIGS. 6(A) and 6(B) are cross sectional views of the first connector 10 and the second connector 60 in the mated state shown in FIG. 5. FIG. 6(A) is a longitudinal sectional view taken along the arrows Z-Z shown in FIG. 3(B), similarly to FIG. 4(A). FIG. 6(B) is a transverse sectional view taken along the arrows Y-Y shown in FIG. 3(B), similarly to FIG. 4(B).

Once the mating starts, the abutment removal portion 72 of the second connector 60 abuts against the locking arm 25 provided on top of the first housing 20 of the first connector 10 and extending rearward and obliquely upward. Then, as the mating progresses further, the abutment removal portion 72 depresses the locking arm 25 to deflect the locking arm 25 elastically. Thereupon, the abutting portion 24 of the locking arm 25 depresses the stepped portion 533 at the distal end of the beam portion 53 of the CPA 50, and thereby the beam portion 53 is also depressed elastically. Then, in the final step of the mating, the abutment removal portion 72 passes over the abutting portion 24 depressed.

Once the abutment removal portion 72 passes over the abutting portion 24, as shown in FIG. 5 and FIGS. 6(A) and 6(B), the abutting portion 24 and the abutment removal portion 72 interchange longitudinal (in the direction of the arrow X) positions. The locking groove 73 is formed in a position adjacent to the abutment removal portion 72 of the second housing 70 of the second connector 60. Accordingly, once the abutment removal portion 72 passes over the abutting portion 24, the elastic deformation of the locking arm 25 is removed and the abutting portion 24 penetrates the locking groove 73. Thereby, the first connector 10 and the second connector 60 mate completely, and at the same time the engagement of the abutting portion 24 and the abutment removal portion 72 locks the first connector 10 and the second connector 60 in the completely-mated state.

However, in the completely-mated state shown in FIG. 5 and FIGS. 6(A) and 6(B), the abutment removal portion 72 is located over the protrusion 532 of the beam portion 53 of the CPA 50. Accordingly, the beam portion 53 remains depressed by the abutment removal portion 72.

Figure 7:
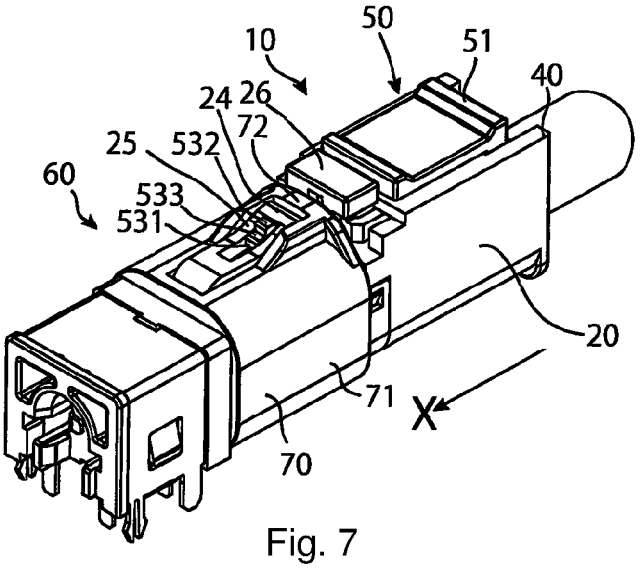
FIG. 7 is a perspective view of a state in which the CPA has been moved to a second position from the mated state.
Figure 8A:
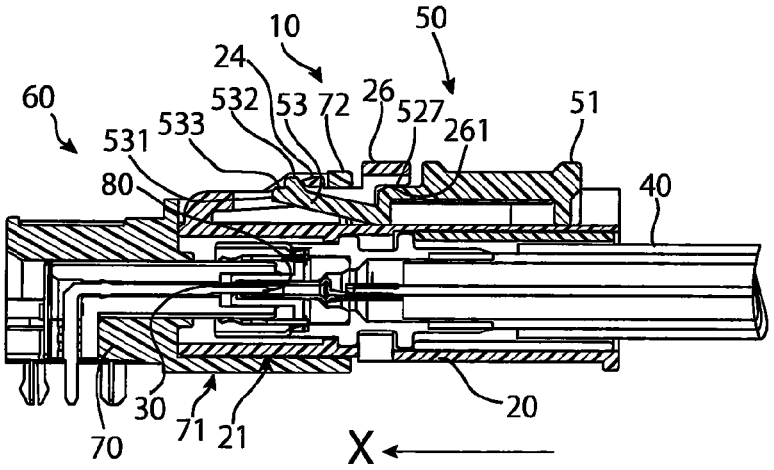
FIG. 8(A) is a sectional side view of the first connector and the second connector with the CPA moved to the second position.
Figure 8B:
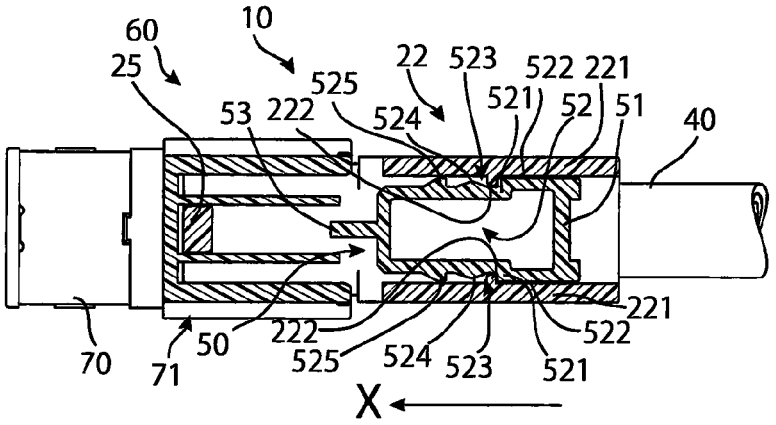
FIG. 8(B) is a sectional top view of the first connector and the second connector with the CPA moved to the second position.

FIG. 7 is an isometric view showing a state in which the CPA 50 has been further slid to the second position from the completely-mated state shown in FIG. 5. FIGS. 8(A) and 8(B) are cross sectional views of the first connector 10 and the second connector 60 with the CPA 50 slid to the second position. FIG. 8(A) is a longitudinal sectional view taken along the arrows Z-Z shown in FIG. 3(B). FIG. 8(B) is a transverse sectional view taken along the arrows Y-Y shown in FIG. 3(B). In FIG. 7 and FIGS. 8(A) and 8(B), the CPA 50 is in the second position slid frontward (in the direction of the arrow X) from the first position shown in FIG. 1(A) and FIGS. 3(A) and 3(B) to FIGS. 6(A) and 6(B).

As shown in FIG. 6(A), when the CPA 50 is still in the first position in the completely-mated state, the beam portion 53 of the CPA 50 remains depressed. That is, the abutment of the beam portion 53 on the abutting portion 24 has been removed. Accordingly, in this step, what prevents frontward (in the direction of the arrow X) movement of the CPA 50 is only the interference between the protruding portion 222 and the bulging portion 524 shown in FIG. 6(B). In that state, next, the operating portion 51 of the CPA 50 is pushed frontward (in the direction of the arrow X) with a force enough to overcome the interference therebetween. Thereupon, the CPA 50 slides frontward (in the direction of the arrow X) to the second position shown in FIG. 7 and FIGS. 8(A) and 8(B), while being guided by the guiding portion 22 of the first housing 20, with a click feel due to the interference therebetween.

In this manner, the CPA 50 can move to the second position only after the first connector 10 and the second connector 60 are put into the completely-mated state. In this second position, shown in FIGS. 7-8(B), a lower face 261 of the operating portion 26 of the locking arm 25 abuts against an upper face 527 of a front end portion 526 of the base portion 52 of the CPA 50, and thereby depression of the operating portion 26 of the locking arm 25 is blocked. That is, the fact that the CPA 50 has been slid to the second position assures that the connectors 10, 60 are in the completely-mated state. Also, in this completely-mated state, because the protruding portion 222 is located at the rear of the spaced portion 523, and a force to make the bulging portion 524 get over the protruding portion 222 is required in order to remove the completely-mated state, an unintentional action cannot cause the completely-mated state to be removed. Therefore, the completely-mated state is maintained.

It should be noted that, here, the mating of the first connector 10 and the second connector 60 and the sliding of the CPA 50 are described separately. However, in the case of the present embodiment, it is also possible to mate them while pushing the operating portion 51 of the CPA 50 from a step before they reach the complete mating. In that case, the mating is progressed by pushing the operating portion 51 of the CPA 50, and the CPA 50 slides to the second position immediately after the complete mating.

In order to separate the first connector 10 and the second connector 60 in the completely-mated state from each other, first, the operating portion 51 of the CPA 50 is pulled rearward (in the opposite direction of the arrow X) to move the CPA 50 to the first position. Next, the operating portion 26 of the locking arm 25 of the first housing 20 of the first connector 10 is depressed with a finger or the like to unlock the abutting portion 24 and the abutment removal portion 72. By this unlocking, the first connector 10 and the second connector 60 are separated from each other.

In this manner, the present embodiment is provided with the abutting portion 24 abutting on the beam portion 53 of the CPA 50, and, separately from the abutting portion 24, it is provided with the protruding portion 222 and the bulging portion 524 interfering with each other during sliding of the CPA 50 to give resistance to the sliding. Therefore, even if the beam portion 53 of the CPA 50 has a narrow width, the sliding of the CPA 50 to the second position correctly assures that the connectors are in the completely-mated state. The CPA 50 is thereby adapted to a narrow first housing 20 of the connector 10.

It should be noted that, though there are two beams 521 of the base portion 52 in the present embodiment, the number of beams 521 may be one or three or more according to the shape of the connector 10. Also, where the spaced portion 523, the bulging portion 524, and the retaining portion 525 are provided may not necessarily be the external side face of the beam 521.

Furthermore, though the base portion 52 of the present embodiment is guided by the guiding portion 22 to slide between the first position and the second position, the movement between the first position and the second position may include a plurality of movements, for example, rotation and movement in another direction, as well as the longitudinal movement.

The base portion 52 of the present embodiment has the guided portion 522, the spaced portion 523, the bulging portion 524 and the retaining portion 525 at the same time, but the base portion 52 may have another shape as long as an equivalent function can be achieved, and may not necessarily have all the elements. Some of the elements may be provided outside the rail 221. Furthermore, the number of rails 221 may be one or three or more.

What is claimed is:

1. A connector, comprising:

a housing having a mating portion, a guiding portion, and an abutting portion, the mating portion adapted to mate with a mating connector, the guiding portion provided at a rear further from the mating connector than the mating portion or provided from the rear to the mating portion; and a connector position assurance device movable between a first position and a second position different from the first position, the connector position assurance device in the second position assuring that the connector is completely mated with the mating connector or maintaining a completely mated state, the connector position assurance device comprising:

a base portion guided by the guiding portion between the first position and the second position;

an operating portion attached to the base portion and adapted to be operated by a user for moving the connector position assurance device, the base portion and the operating portion defining a slot therebetween slidably receiving a portion of the housing; and a beam portion protruding from the base portion to the mating portion, the abutting portion abuts on the beam portion in the first position during non-mating with the mating connector to block movement of the connector position assurance device to the second position, the mating connector during complete mating deforms the beam portion to remove the abutment of the beam portion on the abutting portion to allow the connector position assurance device to move to the second position, wherein the guiding portion has a pair of guiding rails received within the slot and slidably holding the connector position assurance device from both widthwise sides thereof in a direction transverse to a moving direction of the connector position assurance device to guide movement of the connector position assurance device, the operating portion sliding over a top surface of the guiding rails along an exterior surface of the housing as the base portion is guided between the first position and the second position.

2. The connector of claim 1, wherein the connector position assurance device has a spaced portion spaced from one of the guiding rails.

3. The connector of claim 2, wherein the connector position assurance device has a bulging portion bulging toward one of the guiding rails within the spaced portion.

4. The connector of claim 3, wherein the guiding portion has a protruding portion protruding from one of the guiding rails in front of the bulging portion when the connector position assurance device is in the first position.

5. The connector of claim 4, wherein the protruding portion interferes with the bulging portion and provides a resistance when the connector position assurance device in the first position moves to the second position.

6. The connector of claim 5, wherein the protruding portion is positioned behind the bulging portion when the connector position assurance device is in the second position.

7. The connector of claim 6, wherein the bulging portion and the protruding portion interfere with each other when the connector position assurance device tries to move from the second position to the first position, maintaining the completely mated state.

8. A connector assembly, comprising:

a first connector including:

a housing having a mating portion, a guiding portion, and an abutting portion, the guiding portion provided at a rear further from a mating end of the housing than the mating portion or provided from the rear to the mating portion; and a connector position assurance device movable between a first position and a second position different from the first position, the connector position assurance device comprising:

a base portion guided by the guiding portion between the first position and the second position;

an operating portion attached to the base portion and adapted to be operated by a user for moving the connector position assurance device, the base portion and the operating portion defining a slot therebetween slidably receiving a portion of the housing; and a beam portion protruding from the base portion to the mating portion, the abutting portion abuts on the beam portion in the first position during non-mating to block movement of the connector position assurance device to the second position; and a second connector matable with the mating portion of the first connector, the connector position assurance device in the second position assuring that the first connector is completely mated with the second connector or maintaining a completely mated state, the second connector has an abutment removal portion deforming the beam portion during complete mating to remove the abutment of the beam portion on the abutting portion to allow the connector position assurance device to move to the second position, wherein the guiding portion has a pair of guiding rails received within the slot and slidably holding the connector position assurance device from both widthwise sides thereof in a direction transverse to a moving direction of the connector position assurance device to guide movement of the connector position assurance device, the operating portion sliding over a top surface of the guiding rails along an exterior surface of the housing as the base portion is guided between the first position and the second position.

9. The connector of claim 1, wherein the guiding rails each define a protruding portion adapted to engage with the connector position assurance device for resisting its movement in each direction between the first position and the second position.

10. The connector of claim 9, wherein the guiding rails extend in the moving direction of the connector position assurance device along a length of the housing and define respective inwardly facing and opposing surfaces.

11. The connector of claim 10, wherein the connector position assurance device includes first and second bulging portions each extending toward a respective opposing surface of the guiding rails, and wherein each of the protruding portions protrude from a respective one of the opposing surfaces of the guiding rails and in front of a respective one of the bulging portions when the connector position assurance device is in the first position.

12. The connector of claim 11, wherein each protruding portion interferes with one of the first or second bulging portions and provides a resistance when the connector position assurance device in the first position moves to the second position.

13. The connector of claim 1, wherein the base portion includes a pair of beams extending in the moving direction of the connector position assurance device and engaging with the pair of guiding rails, the operating portion arranged over the pair of beams and defining the slot therebetween for slidably receiving the housing.

14. The connector of claim 13, wherein the pair of beams include respective guided portions contacting the pair of guiding rails as the base portion is moved between the first position and the second position, the guided portions defined at a rear of the base portion opposite the beam portion for limiting the movement of the base portion in a direction toward the second position.

15. The connector of claim 13, wherein respective first and second ends of each of the beams of the pair of beams are joined.

16. The connector of claim 1, wherein the slot is open at an end proximate the beam portion and closed at an end opposite the beam portion.

17. The connector of claim 1, wherein the slot is defined in a vertical direction between a top surface of the base portion and a bottom surface of the operating portion, the operating portion sliding over a top surface of each of the guiding rails as the base portion is guided between the first position and the second position.

18. The connector of claim 1, wherein each guiding rail extends from a respective lateral side of the housing and into the slot in a direction transverse to the moving direction.

19. A connector, comprising:

a housing having:

a mating portion for mating with a mating connector;

a guiding portion including a pair of guiding rails; and an abutting portion; and a connector position assurance device movable between a first position and a second position, the connector position assurance device in the second position assuring that the connector is completely mated with the mating connector or maintaining a completely mated state, the connector position assurance device including:

a base portion arranged between the pair of guiding rails in a width direction of the base portion;

an operating portion attached to the base portion and adapted to be operated by a user for moving the connector position assurance device, the base portion and the operating portion defining a slot therebetween slidably receiving the guiding rails in each of the first and second positions, the operating portion sliding over a top surface of the guide rails as the base portion is guided between the first position and the second position; and a beam portion protruding from the base portion to the mating portion, the abutting portion abuts on the beam portion in the first position during non-mating with the mating connector to block movement of the connector position assurance device to the second position, the mating connector during complete mating deforms the beam portion to remove the abutment of the beam portion on the abutting portion to allow the connector position assurance device to move to the second position.

20. The connector of claim 19, wherein each guiding rail extends into the slot in a direction transverse to the moving direction.

* * * * *